US011408262B2

(12) United States Patent
Reckels et al.

(10) Patent No.: US 11,408,262 B2
(45) Date of Patent: Aug. 9, 2022

(54) MOBILE FRACKING PUMP TRAILER

(71) Applicants: Siemens Energy Global GmbH & Co. KG, Munich (DE); SPM Oil & Gas Inc., Fort Worth, TX (US)

(72) Inventors: Udo Reckels, Neuss (DE); Dalia El Tawy, Houston, TX (US); Wesley P. Clark, Weatherford, TX (US); Charles Benjamin Shuck, Azle, TX (US); Bryan C. Wagner, Aledo, TX (US)

(73) Assignees: SPM Oil & Gas Inc., Fort Worth, TX (US); Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 16/857,948

(22) Filed: Apr. 24, 2020

(65) Prior Publication Data

US 2020/0340344 A1 Oct. 29, 2020

Related U.S. Application Data

(60) Provisional application No. 62/838,929, filed on Apr. 25, 2019.

(51) Int. Cl.

| | |
|---|---|
| ***E21B 43/16*** | (2006.01) |
| ***E21B 43/26*** | (2006.01) |
| ***F04B 17/03*** | (2006.01) |
| ***F04B 15/02*** | (2006.01) |
| ***F04B 9/02*** | (2006.01) |
| ***F04B 23/00*** | (2006.01) |
| ***E21B 41/00*** | (2006.01) |

(52) U.S. Cl.

CPC ..... *E21B 43/2607* (2020.05); *E21B 41/0085* (2013.01); *E21B 43/16* (2013.01)

(58) Field of Classification Search

None

See application file for complete search history.

(56) References Cited

U.S. PATENT DOCUMENTS

| | | | | |
|---|---|---|---|---|
| 10,895,202 | B1 * | 1/2021 | Yeung | E21B 43/2607 |
| 10,914,155 | B2 * | 2/2021 | Oehring | F04B 17/03 |
| 10,988,998 | B2 * | 4/2021 | Fischer | H02B 1/52 |

(Continued)

OTHER PUBLICATIONS

Klaus Brun, Ph.D., Christoph Meyenberg, Joseph Thorp, Rainer Kurz, Ph.D.; Hydrodynamic Torque Converters for Oil & Gas Compression and Pumping Applications Basic Principles, Performance Characteristics and Applications; 44th Turbomachinery & 31st Pump Symposia Houston, TX, Sep. 14-17, 2015; George R. Brown Convention Center.

*Primary Examiner* — Matthew Troutman
*Assistant Examiner* — Douglas S Wood

(57) ABSTRACT

A mobile fracking pump trailer 100 includes a gas turbine engine 102 and fracking pump 104, and torque converter 114 that fluidly couples the gas turbine engine 102 to the fracking pump 104. The mobile fracking pump trailer 100 further includes a first reduction gearing 118 connected between the gas turbine engine 102 and the torque converter 114 and a first power takeoff 120 connected to first reduction gearing 118. An electrical machine 128 is connected to the first power takeoff 120 for selectively starting the gas turbine engine 102 and generating electrical power to power the mobile fracking pump trailer 100 after the gas turbine engine 102 has been started.

11 Claims, 1 Drawing Sheet

(56) References Cited

U.S. PATENT DOCUMENTS

| | | | | |
|---|---|---|---|---|
| 2009/0308602 | A1* | 12/2009 | Bruins | E21B 43/26 166/250.01 |
| 2016/0369609 | A1* | 12/2016 | Morris | E21B 43/26 |
| 2019/0154020 | A1* | 5/2019 | Glass | F04B 17/03 |
| 2019/0178335 | A1* | 6/2019 | Manzoor | F16F 15/1442 |
| 2020/0040878 | A1* | 2/2020 | Morris | F04B 17/05 |

* cited by examiner

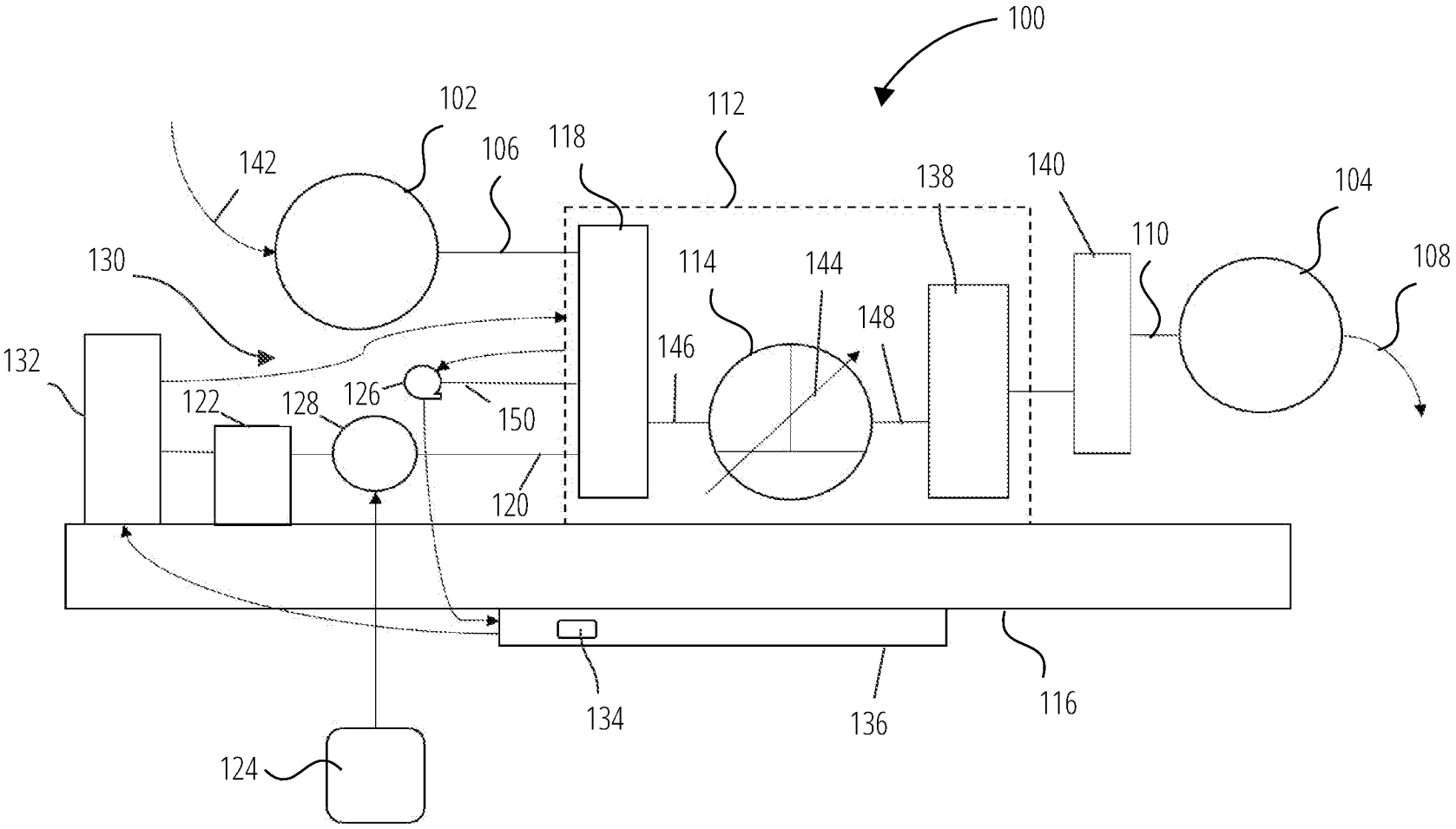
100
102
104
106
108
110
112
114
116
118
120
122
124
126
128
130
132
134
136
138
140
142
144
146
148
150

MOBILE FRACKING PUMP TRAILER

CROSS-REFERENCE TO RELATED APPLICATIONS

This application claims priority to U.S. provisional application No. 62/838,929 filed on Apr. 25, 2019.

BACKGROUND

In conventional hydraulic fracturing ("fracking") operations, diesel engines are used to drive fracking pumps via a multi-speed transmission.

BRIEF SUMMARY

A mobile fracking pump trailer includes a gas turbine engine operable at a desired engine speed, an engine output shaft coupled to the gas turbine engine for rotation at a desired engine shaft output speed; a fracking pump configured for pumping a fracking slurry down a wellbore, the fracking pump comprising a fracking pump input shaft operable at a desired pump input speed; a torque converter assembly comprising a torque converter that fluidly couples the engine output shaft and the fracking pump input shaft, the torque converter operable at a desired torque converter input speed and providing a variable torque converter output speed for delivering power to the fracking pump at the desired pump input speed according to its pumping load without requiring shifting of gears; a first reduction gearing, connected between the engine output shaft and a torque converter input shaft for reducing the desired engine shaft output speed to the desired torque converter input speed transmitted to the torque converter, a first power takeoff connected to the first reduction gearing, an electrical system for distributing electrical power to the mobile fracking pump trailer, an electrical machine connected to the first power takeoff for selectively driving the engine output shaft through the first reduction gearing when energized by an offboard electrical power source to start the gas turbine engine in a starting mode, and for extracting power from the engine output shaft through the first reduction gearing for generating electricity provided to the electrical system in a generating mode when the gas turbine engine is running, whereby the electrical system is powered by the electrical machine after starting of the gas turbine engine by a offboard electrical power source, and the gas turbine engine, the torque converter assembly, the fracking pump, the first reduction gearing, the first power takeoff, the electrical system, and the electrical machine being configured to fit in an operating arrangement on a single platform so that the mobile fracking pump trailer can be transported on roads as one unit.

A method of operating a mobile fracking pump trailer includes, on a single platform that can be transported on roads as one unit: mounting, in an operating arrangement, a gas turbine engine operable at a desired engine speed and comprising an engine output shaft coupled to the gas turbine engine for rotation at a desired engine shaft output speed to a fracking pump configured for pumping a fracking slurry down a wellbore, the fracking pump comprising a fracking pump input shaft operable at a desired pump input speed via a torque converter assembly comprising a torque converter that fluidly couples the engine output shaft and the fracking pump input shaft, the torque converter operable at a desired torque converter input speed and providing a variable torque converter output speed for delivering a desired power to the fracking pump at the desired pump input speed according to its pumping load without requiring shifting of gears; mounting a first reduction gearing, connected between the engine output shaft and a torque converter input shaft for reducing the desired engine shaft output speed to the desired torque converter input speed transmitted to the torque converter, connecting a first power takeoff to the first reduction gearing; connecting an electrical machine to the first power takeoff; selectively driving the turbine engine output shaft through the first reduction gearing by remotely energizing the electrical machine from an offboard electrical power source to start the gas turbine engine in a starting mode; and extracting power from the engine output shaft through the first reduction gearing and generating electricity delivered to the electrical system in a generating mode when the gas turbine engine is running

BRIEF DESCRIPTION OF THE SEVERAL VIEWS OF THE DRAWINGS

To easily identify the discussion of any particular element or act, the most significant digit or digits in a reference number refer to the FIGURE number in which that element is first introduced.

The FIGURE illustrates a mobile fracking pump trailer 100 in accordance with an embodiment.

DETAILED DESCRIPTION

A frack spread (or sometimes referred to as a frack fleet) is a set number of equipment that a pressure pumper (oil field service company) uses for hydraulic fracturing. The convention today is to use diesel engines to drive frack pumps via a multi-speed transmission. Because of low reliability and intermittent duty (cannot operate 24/7) of this setup, operators typically run the equipment at lower power than what the equipment is rated, which results in not only requiring the deployment of more equipment than necessary, but also having to have additional backup units onsite. It has been recognized that the reciprocating movement of both the frack pump and the diesel engine results in heavy stresses in the entire drive train. The pump, diesel engine, and transmission are typically placed inside a trailer. When a pump trailer fails, the speed of the remaining pumps can be increased and/or a backup pump can be added.

Further, due to the differences in the torque speed characteristic of the diesel engine and the frack pump, the inclusion of a multispeed transmission is necessary to exploit the pump operating envelope as much as possible. Nevertheless, due to inherent limitations of a transmission, it is not possible to cover the entire pump envelope so that some regions remain out of reach. Additionally, to remain in the operating envelope of the system and keep at the same time reserve capacity, gears and speeds are chosen carefully in case of a failure. To isolate the pump from the drive train, vibration dampeners are ideally installed between the pump and the transmission. However, due to the high cost and heavy weight, operators are often reluctant to include them in the frack fleet.

In addition to aforementioned issues, typical frack spread equipment also suffer from limited control capability of the fluid flow rate and challenges during pressure testing. For pressure testing of the system, it is necessary to only add very small amounts of liquid to the system. As water is incompressible, this can require less than one turn of the pump's crankshaft. To accomplish this, the transmission is "bumped" in and out of gear, which results in limited accuracy and yields high stresses in the system. Personnel safety can also be compromised when bumping the transmission in and out of gear. If the transmission stays in gear too long, the pressure limit of the system can be exceeded and result in an unintended and uncontrolled release of pressure.

The fracking industry desires to increase the amount of pump power installed on the back of one trailer to reduce equipment footprint onsite. Because of weight and size limitations for road transport, today's diesel engine-based systems are at the edge of practicality—overweight and thus requiring the added expense of annual permitting, for example. Consequently, foreseeable future diesel solutions would have even more transportation issues. Moreover, the most powerful multi-speed transmission available today allows for 3500 HP, which represents a power increase of only 40%.

Heretofore these issues have been addressed by the use of electric-driven pumps. The use of electric pumps improves the reliability, flow rate, and pressure testing issues. Further, the pumping power of an electric-driven pump on one trailer can be higher than that on one diesel-driven pump. However, besides the pump trailers, the electric solution also requires additional trailers for power generation, thus increasing the equipment footprint. The present innovation proposes a gas turbine fluidically connected to a pump via a torque converter (optionally, including reduction gearing) thereby achieving higher pumping power in a smaller footprint than a diesel powered drive train. In one exemplary embodiment, the gas turbine engine may be implemented by a SIEMENS SGT A05 mobile power unit. In one exemplary embodiment, the gas turbine and the torque converter are designed to provide a minimum available shaft power of 5000 HP. In one exemplary embodiment, the gas turbine engine, torque converter, and pump are rated for continuous operation (24/7) of a minimum of 5000 HP. In this embodiment, the trailer weight of this gas turbine engine solution is similar to the conventional diesel-based 2500 HP pump trailers.

By replacing the diesel engine with a gas turbine engine, the drive train causes minimal or no vibration in the system and consequently minimizes or removes high stresses. To isolate the torsional activity and vibrations from the pump, the drive train is mechanically disconnected from the pump by an industrial torque converter, such as a Voith hydrodynamic torque converter. In one embodiment, since the frack pump speed is controlled continuously with the torque converter, then no transmission gear shifting, and its corresponding shifting control and shifting wear, is necessary for this setup. Compared to a multi-speed transmission, a torque converter changes the output speed continuously up to the full power of the gas turbine. In such an embodiment, the full operating envelope of the pump is available. In one exemplary embodiment, the drive train includes a gas turbine engine, a torque converter, multiple lube oil pumps, and a starter-generator that are coupled to the frack reciprocating pump.

In one embodiment, due to the higher reliability and power density of the gas turbines compared to diesel engines, the gas turbine engine implementation requires fewer trailers onsite. The FIGURE is an illustration of such an embodiment with reduced footprint associated with the gas turbine-based pump trailer compared to a similar output diesel powered system. Further, because of the use of the variable speed control of the torque converter, pressure testing can be completed without the risk of over-pressuring the system.

The frack pump may be implemented by, for example, a WEIR SPM QEM 3000 or WEIR SPM QEM 5000 pump. A QEM 3000 pump delivering 39,000 HP or eight QEM 5000 pumps delivering 40,000 HP can be deployed in exemplary embodiments.

The gas turbine engine implementation is also more advantageous than an electrical solution. Although more reliable than the diesel pump, usually an onsite electrician is on site to service the electric-driven pump and associated components. Also, the rigging and routing of electric cables may consume additional effort and time.

The FIGURE shows an embodiment of a mobile fracking pump trailer 100 incorporating a torque converter-coupled drive train. The mobile fracking pump trailer 100 includes a gas turbine engine 102 operable at a desired engine speed and having an engine output shaft 106 coupled to the gas turbine engine 102 for rotation at a desired engine shaft output speed. The gas turbine engine 102 receives a flow of fuel 142 from an off-board fuel source, such as a compressed natural gas tank or gas extracted from a local gas field. The mobile fracking pump trailer 100 includes a fracking pump 104 configured for pumping a fracking slurry 108 down a wellbore in a hydraulic fracking process. In an aspect, the fracking pump 104 is a reciprocating pump. The fracking pump 104 comprising at least one fracking pump input shaft 110 operable at a desired pump input speed. A torque converter assembly 112 comprising a torque converter 114 that fluidly couples the engine output shaft 106 and the fracking pump input shaft 110. The torque converter 114 is operable at a desired torque converter input speed and provides a variable torque converter output speed for delivering power to the fracking pump 104 at the desired pump input speed according to its pumping load. Unlike conventional diesel engine-powered fracking pump 104 drive trains wherein the diesel engine shaft is coupled to a fracking pump 104 via a transmission, the torque converter assembly 112 does not require shifting of gears. Advantageously, the gas turbine engine 102 can remain at the desired engine speed independently of the changing demands of a fracking fluid pumping operation. The torque converter 114 includes a plurality of adjustable vanes 144 therein to control the level of hydraulic coupling and, accordingly, the speed and torque delivered to the fracking pump 104.

The mobile fracking pump trailer 100 may further include a first reduction gearing 118, connected between the engine output shaft 106 and the torque converter input shaft 146 for reducing the desired shaft desired engine shaft output speed transmitted to the torque converter 114. The first reduction gearing 118 may include one or more gears integrally contained within a housing of the torque converter assembly 112. The mobile fracking pump trailer 100 may further include a first power takeoff 120 connected to the first reduction gearing 118. The first power takeoff 120 may extend from a housing of torque converter assembly 112. The mobile fracking pump trailer 100 may further include an electrical system 122 for distributing electrical power to the mobile fracking pump trailer 100. The mobile fracking pump trailer 100 may further include an electrical machine 128 connected, for example, to the first power takeoff 120 for selectively driving the engine output shaft 106 through the first reduction gearing 118 when energized, in one aspect, by an offboard electrical power source 124, such as an offboard generator or local electrical grid, to start the gas turbine engine 102 in a starting mode, wherein the electrical machine 128 functions as an electrical motor. Advantageously, the electrical machine 128, to save weight and space, can be operated as a generator for extracting power from the engine output shaft 106 through the first reduction gearing 118 for generating electricity provided to the electrical system 122 in a generating mode when the gas turbine engine 102 is running, whereby the electrical system 122 is powered by the electrical machine 128, for example, an off-board generator or after starting of the gas turbine engine 102 after starting of the gas turbine engine by the offboard electrical power source 124. The electrical system 122 can then distribute electrical power to various electrical loads onboard the mobile fracking pump trailer 100 so that the trailer is electrically self-powered without needing an off-board electrical power source 124. The mobile fracking pump trailer 100 also includes a single platform 116 for mounting the gas turbine engine 102, the torque converter assembly 112, the first reduction gearing 118, the first power takeoff 120, the electrical system 122, the electrical machine 128, and the fracking pump 104 thereon, enabling the mobile fracking pump trailer 100 to be transported on roads as one unit.

In another aspect, the mobile fracking pump trailer 100 may also include a second reduction gearing 138 disposed between the torque converter output shaft 148 and the fracking pump input shaft 110 for reducing the desired pump input speed transmitted to the fracking pump 104. The second reduction gearing 138 may include one or more gears integrally contained within a housing of the torque converter assembly 112. In an aspect, mobile fracking pump trailer 100 may also include a third reduction gearing 140 disposed between the second reduction gearing 138 and the fracking pump input shaft 110 for reducing the desired pump input speed transmitted to the fracking pump 104. The mobile fracking pump trailer 100, may also include a second power takeoff 150 for driving an oil pump 126 to pump oil in an oil circulation circuit 130. The oil circulation circuit 130 may circulate oil to at least one of the fracking pumps 104, the gas turbine engine 102, and the torque converter assembly 112. In an aspect, the oil circulation circuit may include at least one of an oil cooler 132 and an oil heater 134. The oil cooler 132 may be mounted on an upper portion of the single platform 116 away from the fracking pump 104, the gas turbine engine 102, and the torque converter assembly 112 and may include fans powered by the electrical system 122. The oil circulation circuit 130 may include an oil reservoir 136, for example, attached to an underside of the single platform 116 to save space, provide a lower center of gravity, and keep it out of the away of the drive chain. The electrical machine 128 may provide electrical power to at least one of the oil cooler 132 and the oil heater 134 in a generating mode, for example via the electrical system 122.

A method of operating a mobile fracking pump trailer 100 on a single platform that can be transported on roads as one unit comprises mounting, in an operating arrangement, a gas turbine engine 102 operable at a desired engine speed and comprising a turbine engine output shaft 106 coupled to the gas turbine engine 102 for rotation at a desired engine shaft output speed to a fracking pump 104 configured for pumping a fracking slurry 108 down a wellbore. The fracking pump 104 includes a fracking pump input shaft 110 operable at a desired pump input speed via a torque converter assembly 112 comprising a torque converter 114 that fluidly couples the engine output shaft 106 and the fracking pump input shaft 110, the torque converter 114 operable at a desired torque converter input speed and providing a variable torque converter output speed for delivering power to the fracking pump 104 at the desired pump input speed according to its pumping load without requiring shifting of gears. The method further includes mounting a first reduction gearing 118, connected between the engine output shaft 106 and a torque converter input shaft 146 for reducing the desired engine shaft output speed to the desired torque converter input speed transmitted to the torque converter 114. The method further includes connecting a first power takeoff 120 to the first reduction gearing 118, connecting an electrical machine 128 to the first power takeoff 120. The method further includes selectively driving the turbine engine output shaft 106 through the first reduction gearing 118 by remotely energizing the electrical machine 128 from an offboard electrical power source 124 to start the gas turbine engine 102 in a starting mode and extracting power from the engine output shaft 106 through the first reduction gearing 118 and generating electricity delivered to the electrical system 122 in a generating mode when the gas turbine engine 102 is running. The method further includes powering the electrical system 122 by the electrical machine 128 after starting of the gas turbine engine 102 for distributing electrical power to the mobile fracking pump trailer 100.

The features of the present description which are believed to be novel are set forth below with particularity in the appended claims. However, modifications, variations, and changes to the exemplary embodiments described above will be apparent to those skilled in the art, and the gas turbine-based drive train for a frac pump described herein thus encompasses such modifications, variations, and changes and are not limited to the specific embodiments described herein.

What is claimed is:

1. A mobile fracking pump trailer comprising:

a gas turbine engine operable at a desired engine speed, an engine output shaft coupled to the gas turbine engine for rotation at a desired engine shaft output speed;

a fracking pump configured for pumping a fracking slurry down a wellbore, the fracking pump comprising a fracking pump input shaft operable at a desired pump input speed;

a torque converter assembly comprising a torque converter that fluidly couples the engine output shaft and the fracking pump input shaft, the torque converter operable at a desired torque converter input speed and providing a variable torque converter output speed for delivering power to the fracking pump at the desired pump input speed according to its pumping load without requiring shifting of gears;

a first reduction gearing, connected between the engine output shaft and a torque converter input shaft for reducing the desired engine shaft output speed to the desired torque converter input speed transmitted to the torque converter, a first power takeoff connected to the first reduction gearing, an electrical system for distributing electrical power to the mobile fracking pump trailer, an electrical machine connected to the first power takeoff for selectively driving the engine output shaft through the first reduction gearing when energized by an off-board electrical power source to start the gas turbine engine in a starting mode, and for extracting power from the engine output shaft through the first reduction gearing for generating electricity provided to the electrical system in a generating mode when the gas turbine engine is running, whereby the electrical system is powered by the electrical machine after starting of the gas turbine engine by a offboard electrical power source, and the gas turbine engine, the torque converter assembly, the fracking pump, the first reduction gearing, the first power takeoff, the electrical system, and the electrical machine being configured to fit in an operating arrangement on a single platform so that the mobile fracking pump trailer can be transported on roads as one unit.

2. The mobile fracking pump trailer of claim 1, further comprising a second reduction gearing disposed between the torque converter output shaft and the fracking pump input shaft for reducing the desired pump input speed transmitted to the fracking pump.

3. The mobile fracking pump trailer of claim 1, wherein fracking pump is a reciprocating pump.

4. The mobile fracking pump trailer of claim 1, further comprising a second power takeoff for driving an oil pump to pump oil in an oil circulation circuit to at least one of the fracking pumps, the gas turbine engine, and the torque converter assembly.

5. The mobile fracking pump trailer of claim 4, the oil circulation circuit further comprising an oil cooler mounted on an upper portion of the single platform away from the fracking pump, the gas turbine engine, and the torque converter assembly.

6. The mobile fracking pump trailer of claim 5, wherein the electrical machine is configured for providing electrical power to the oil cooler in a generating mode.

7. The mobile fracking pump trailer of claim 5, the oil circulation circuit further comprising an oil reservoir.

8. The mobile fracking pump trailer of claim 7, wherein the oil reservoir is attached to an underside of the single platform.

9. The mobile fracking pump trailer of claim 2, further comprising a third reduction gearing disposed between the second reduction gearing and the fracking pump input shaft for further reducing the desired pump input speed transmitted to the fracking pump.

10. A method of operating a mobile fracking pump trailer comprising:

on a single platform that can be transported on roads as one unit:

mounting, in an operating arrangement, a gas turbine engine operable at a desired engine speed and comprising an engine output shaft coupled to the gas turbine engine for rotation at a desired engine shaft output speed to a fracking pump configured for pumping a fracking slurry down a wellbore, the fracking pump comprising a fracking pump input shaft operable at a desired pump input speed via a torque converter assembly comprising a torque converter that fluidly couples the engine output shaft and the fracking pump input shaft, the torque converter operable at a desired torque converter input speed and providing a variable torque converter output speed for delivering a desired power to the fracking pump at the desired pump input speed according to its pumping load without requiring shifting of gears;

mounting a first reduction gearing, connected between the engine output shaft and a torque converter input shaft for reducing the desired engine shaft output speed to the desired torque converter input speed transmitted to the torque converter, connecting a first power takeoff to the first reduction gearing;

connecting an electrical machine to the first power takeoff;

selectively driving the engine output shaft through the first reduction gearing by remotely energizing the electrical machine from an offboard electrical power source to start the gas turbine engine in a starting mode; and extracting power from the engine output shaft through the first reduction gearing and generating electricity delivered to the electrical system in a generating mode when the gas turbine engine is running.

11. The method of claim 10, further comprising powering the electrical system by the electrical machine after starting of the gas turbine engine for distributing electrical power to the mobile fracking pump trailer.

* * * * *